US011306493B2

(12) United States Patent
White

(10) Patent No.: US 11,306,493 B2
(45) Date of Patent: Apr. 19, 2022

(54) FORMWORK BRACE AND METHOD OF CONSTRUCTING A FORMWORK BRACE

(71) Applicant: FAST-FORM SYSTEMS LTD, Grimbsy (GB)

(72) Inventor: Tony White, Cleethorpes (GB)

(73) Assignee: FAST-FORM SYSTEMS LTD, Grimbsy (GB)

( * ) Notice: Subject to any disclaimer, the term of this patent is extended or adjusted under 35 U.S.C. 154(b) by 0 days.

(21) Appl. No.: 17/418,568

(22) PCT Filed: Feb. 7, 2019

(86) PCT No.: PCT/GB2019/050329

§ 371 (c)(1),
(2) Date: Jun. 25, 2021

(87) PCT Pub. No.: WO2020/161453

PCT Pub. Date: Aug. 13, 2020

(65) Prior Publication Data

US 2022/0064970 A1 Mar. 3, 2022

(51) Int. Cl.
*E04G 17/14* (2006.01)
*E04G 9/06* (2006.01)

(52) U.S. Cl.
CPC ..... *E04G 17/14* (2013.01); *E04G 9/06* (2013.01)

(58) Field of Classification Search
CPC ..... E04G 17/14; E01C 19/502
USPC ..... 249/3, 7; 52/127.2; 248/351.1
See application file for complete search history.

(56) References Cited

U.S. PATENT DOCUMENTS 3,817,006 A * 6/1974 Williams ..... E04G 21/26 248/354.3
4,776,555 A * 10/1988 Maynard ..... E01C 19/502 249/7
5,261,635 A * 11/1993 Flathau ..... B28B 23/00 249/7
5,843,327 A * 12/1998 Lindgren ..... E04G 17/14 249/219.1
6,230,451 B1 * 5/2001 Stoller ..... A63C 19/10 52/169.7
6,629,681 B1 * 10/2003 Miller ..... E01C 19/502 249/7

(Continued)

FOREIGN PATENT DOCUMENTS

DE 2553002 A * 6/1977 ..... E01C 19/502
DE 29606112 U1 * 7/1997 ..... E01C 19/502

(Continued)

OTHER PUBLICATIONS

International Search Report and Written Opinion for PCT Application No. PCT/GB2019/050329 dated Nov. 7, 2019, 12 pages.

*Primary Examiner* — Michael Safavi
(74) *Attorney, Agent, or Firm* — Maine Cernota & Rardin

(57) ABSTRACT

Disclosed herein is a concrete formwork suitable for use in shuttering formwork. The formwork comprises a base and a plurality of clamping brackets. The clamping brackets further comprise clamping members that are engageable with the clamping brackets to define clamping portion that are aligned with openings on the base. The base is pivotally connected to a shuttering contact member which is supported by two braces. Also disclosed herein is a method of constructing the disclosed formwork.

10 Claims, 1 Drawing Sheet

(56) References Cited

U.S. PATENT DOCUMENTS

| | | | | |
|---|---|---|---|---|
| 6,752,570 | B2 * | 6/2004 | Lanka | E04G 21/26 52/127.2 |
| 2011/0210234 | A1 * | 9/2011 | Garcia, Jr. | E04G 17/14 249/213 |
| 2016/0194887 | A1 * | 7/2016 | White | E04G 17/12 248/351 |

FOREIGN PATENT DOCUMENTS

| | | | | | |
|---|---|---|---|---|---|
| GB | 2508263 | A | * | 5/2014 | E04G 17/002 |
| KR | 20030079390 | A | | 10/2003 | |
| KR | 2006104644 | A | * | 10/2006 | E04G 17/14 |
| WO | 2017178971 | A | | 10/2017 | |

* cited by examiner

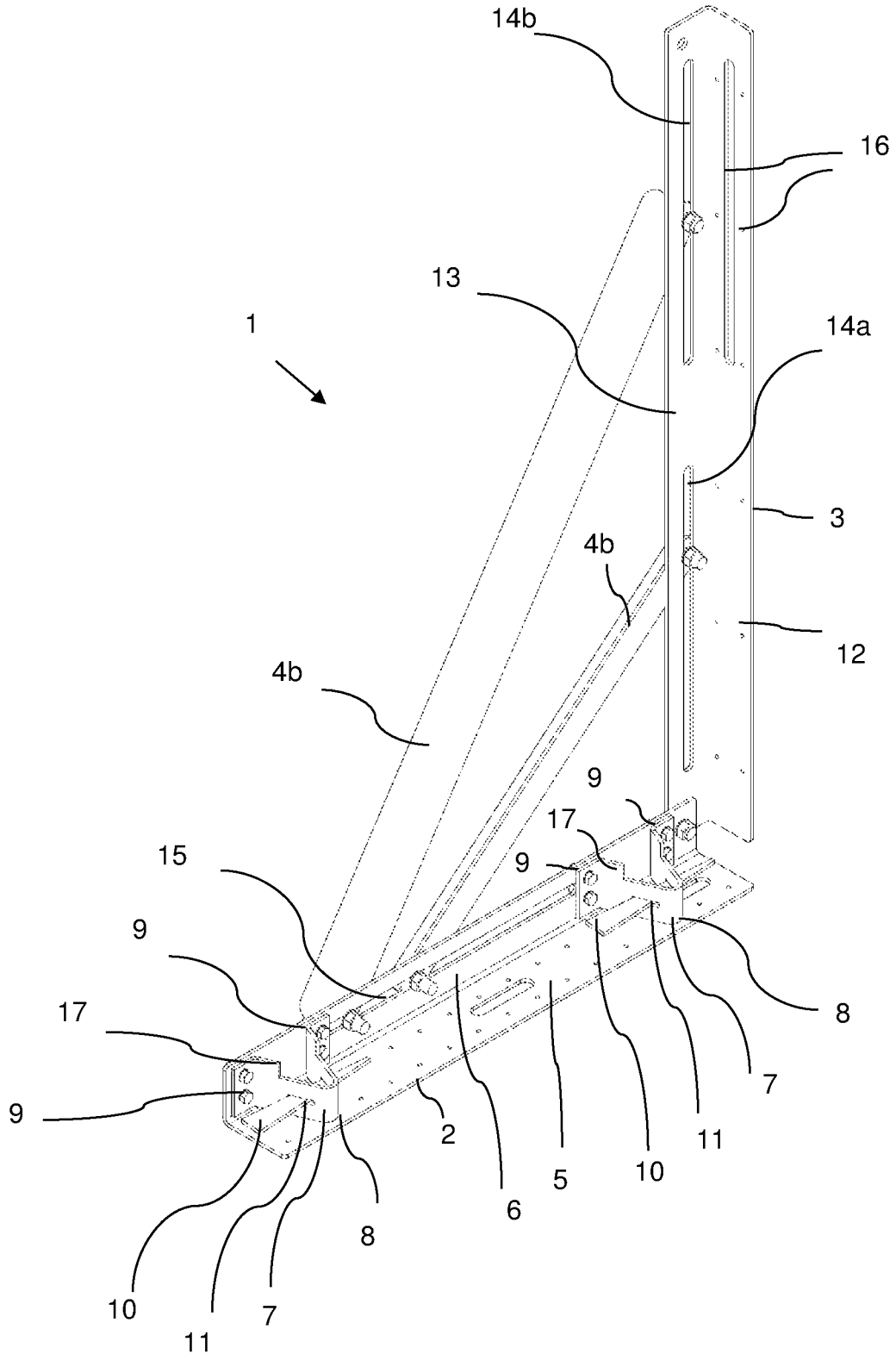
14b
16
13
1
14a
3
4b
12
4b
9
17
9
15
9
8
17
7
9
2
11
10
5
6
8
10
7
11

FORMWORK BRACE AND METHOD OF CONSTRUCTING A FORMWORK BRACE

RELATED APPLICATIONS

This application is a national phase application filed under 35 USC § 371 of PCT Application No. PCT/GB2019/050329 with an International filing date of Feb. 7, 2019, which is incorporated herein by reference in its entirety for all purposes.

FIELD OF THE INVENTION

The present invention relates to a formwork and method of constructing a formwork.

BACKGROUND TO THE INVENTION

Concrete walls, pillars or columns are conventionally formed using formwork which is applied around the edge of the structure to be formed. The formwork supports shuttering contact board which provides a surface against which the concrete can be poured to form the structure. When the concrete is poured, considerable force is applied to the board and consequently to the formwork due to the weight of the concrete. This can cause the formwork to move, and consequently the resultant structure is formed incorrectly.

Thus with any formwork it is necessary to anchor the formwork appropriately to the ground or other static structure so that the formwork does not move when the concrete is poured.

The present solutions offered (such as that described in GB2561567) include brackets which are pined to the ground using road pins. Unfortunately such solutions are not satisfactory because there is too much deflection in the shuttering contact member when the concrete is poured. Also the base tends to be forced upwards by the action of the concrete, and this leads to movement of the whole formwork.

There has now been devised an improved formwork which overcomes and/or substantially mitigates the above referenced and/or other disadvantages associated with the prior art.

SUMMARY OF THE INVENTION

In one aspect of the invention there is provided a concrete formwork comprising,

- a base having a first side configured for contact with the ground in use,
- at least two clamping brackets coupled to an adjacent second side of the base and extending over openings in the first side of the base,
- the clamping brackets further comprising clamping members engageable with the clamping brackets to define a clamping portion superimposed over the openings, the clamping portion being suitable for receiving a pin in use and for retaining the formwork in place with respect to the pin,
- each clamping bracket comprising a cut-out in the top edge of the bracket to receive a extraction tool,
- one end of the second side of the base being pivotally connected to one end of a shuttering contact member,
- the shuttering contact member having a first side for contacting the shuttering board in use, and a second side adjacent the first side,
- a first brace having one end slidingly engaged with a first longitudinal slot in the second side of the shuttering contact member and an opposite end being slidingly engaged with a longitudinal slot spanning the distance between the two clamping brackets in the second side of the base,
- a second brace having one end slidingly engaged with a second longitudinal slot in the second side of the shuttering contact member and an opposite end being slidingly engaged with the same longitudinal slot spanning the distance between the two clamping brackets in the second side of the base,
- wherein the first longitudinal slot is proximal the connection between the base and the shuttering contact member and the second longitudinal slot is distal the connection between the base and the shuttering contact member, and
- wherein adjustment of the brace within either or both of the slots causes rotation of the shuttering contact member about the base in use, the angle of the shuttering contact member with respect to the base being fixable.

The formwork according to the invention is advantageous primarily because a clamping portion is defined which can clamp onto any road pins or the like inserted into the clamping portion. This prevents the formwork from moving with respect to the pins. In use concrete is poured against a board applied to the shuttering contact member of the formwork, an in this instance the formwork is prevented from lifting or moving to any significant degree. Also the load is transferred not only to a region between the two clamping brackets, but to the side of the base from which the brackets are supported. Any pressure on the shuttering contact member will therefore tend to push the second side of the base downward, and thereby force the first side of the base sideways and upwards. The use of the specific combination of clamping brackets and clamping members in this instance prevent such movement and therefore direct transfer of the load to the ground, without significant deflection.

Another advantage of the invention is that different heights of the shuttering contact member can be made, and when different lengths of braces are used, the braces can both be incorporated into the formwork at an angle of 45 degrees.

Preferably the base, shuttering contact member and braces are right angle section members. Preferably the base, shuttering contact member and braces are manufactured from metal, such as steel or aluminium, but other materials such as plastics or composite materials are also possible.

The openings in the first side are preferably spaced apart from one another substantially along the length of the base. This allows roadway pins or the like to be inserted through the base in positions which are separated from one another substantially.

Roadway pins is a term used in the art to describe pins inserted into formwork to support said formwork against a roadway. The pins are conventionally hammered into the surface on which the formwork is placed and are distinguished from fixings which are screwed or bolted into the surface. The term therefore includes any suitable means for fixing into roadways or the ground. Suitable roadway pins or the like includes stakes, screws, bolts, or plugs as it will be recognised that screws and bolts in particular can be hammered into position rather than being screwed into position. Typically a roadway pin is a round pin made of steel with a pointed or sharpened end for penetrating the ground and a flat end that is hit with a hammer or similar in order to drive the pin into the ground. The roadway pin can also be made from plastics, composites or other metals.

Either of the braces, and/or the shuttering contact member may be adjustable in length. For example therefore, the braces may comprise a screw jack, or a telescoping element or the like.

The clamping brackets may be any type of bracket that maximises the clamping portion onto the roadway pin or the like in use. Preferably the clamping brackets are substantially "V" shaped. This is a simple bracket form and increases the strength of the second side of the base. As the brackets are configured to extend over the first side of the base, the combined effect is therefore to reduce the potential for the base to buckle or bend in use. The coupling of the brackets to the base may be by conventional nut and bolt fixing, screws, or welding. The central part of the 'V' provides an opening for receipt of the roadway pin or the like in use.

Preferably, the clamping brackets comprise flattened portions configured to lie flat against the second side of the base in use. This further strengthens the second side of the base and the brackets.

When a 'V' shaped clamping bracket is used, preferably the clamping brackets comprise a first opening and a second opening, the first and second opening being opposite one another and on different sides of the 'V' shaped bracket.

Preferably, wherein the clamping brackets comprise a first opening and a second opening, the first and second openings being opposite one another and on different sides of the 'V' shaped bracket, the first opening being wider than the second opening, both openings being configured to receive a wedge shaped clamping member through the first and second openings, and which matches the dimensions of the first and second openings substantially. This has the benefit that when the wedge is inserted into the clamping bracket therethrough, a clamping portion is defined between the wedge and the inside of the apex of the 'V'. This provides a quick and efficient way to mount the base at the side of the planned formwork or concrete wall/pillar/column etc. As the bracket is 'V' shaped, it maximises the area of the pin or the like that is clamped in the clamping portion. This form of bracket in combination with the wedge maximises the frictional forces that are generated if the support base is attempted to be lifted by the weight of the concrete in use. Thus the formwork does not lift out of the ground in use.

Alternatively, the first opening is of similar dimensions to the second opening and the clamping member comprises a bar having a central cam. When the bar is inserted through the first and second openings, a clamping portion between the bar and the bracket is defined substantially as described above. A roadway pin or the like is inserted through the clamping portion and when the bar is rotated the cam tightens on the roadway pin or the like and clamps the angle section member to the pin.

Preferably the clamping members comprise a retainer to prevent them being lost in use. Preferably, the retainer comprises a weld applied to at least one side of the clamping member.

In another aspect of the invention there is provided a method of constructing a formwork, comprising, coupling at least two clamping brackets to a second side of a base, the clamping brackets being arranged to extend over openings in a first side of the base which is adjacent the second side, and each clamping bracket comprising a cut-out in the top edge of the bracket to receive a extraction tool, engaging clamping members with the clamping brackets to define clamping portions in each bracket superimposed over the openings, pivotally connecting one end of the second side of the base to one end of a shuttering contact member, slidingly engaging one end of a first brace with a first longitudinal slot in the shuttering contact member and slidingly engaging the opposite end of the first brace with a longitudinal slot spanning the distance between the two clamping brackets in the second side of the base, slidingly engaging one end of a second brace with a second longitudinal slot in the shuttering contact member and slidingly engaging the opposite end of the second brace with the same longitudinal slot spanning the distance between the two clamping brackets in the second side of the base, wherein the first longitudinal slot is proximal the connection between the base and the shuttering contact member and the second longitudinal slot is distal the connection between the base and the shuttering contact member, adjusting the braces within either or both of the slots to cause rotation of the shuttering contact member about the base, and fixing the angle of the shuttering contact member with respect to the base.

The method as described above may further comprise the step of applying a retainer to the clamping members after they have been engaged with the clamping brackets. This prevents the clamping members from being lost. The retainer may be a bolt or clamp or the like, but preferably comprises a weld applied to at least one side of the clamping member. Alternatively a simple twist to the clamping member is applied so that it cannot detach easily from the brace.

The method may further comprise the step of wherein in use a roadway pin is inserted through each clamping portion to fixedly mount the formwork to the ground.

The invention will now be described by way of example only with reference to and as shown in the drawings in which:

BRIEF DESCRIPTION OF THE DRAWINGS

FIG. 1 shows a perspective view of an embodiment of the formwork according to the invention.

DETAILED DESCRIPTION OF THE ILLUSTRATED EMBODIMENT

In FIG. 1 there is shown an example of the formwork generally designated 1. The formwork 1 comprises a base member 2, a shuttering contact member 3, and two braces 4*a* and 4*b*. The base 2 and the shuttering contact member 3 are right angle section steel members. The braces 4*a* and 4*b* are a right angle section steel member but are less wide than the other two members. The base 2 has a first side 5, which is the longitudinal side of the base 2 which is in contact with the ground in use. As the base 2 is a right angle section member it has an adjacent second side 6, which also runs longitudinally and is the side which extends away from the ground in use. Two 'V' shaped clamping brackets 7 are bolted to the second side 6 of the base 2 and extend over the first side 5. In the first side 5 of the base 2 there are two openings 8. The brackets 7 are arranged when bolted on so that the apex of each 'V' lies over a respective opening 8, as shown. In order that the brackets 7 may be bolted to the second side 6, at the opposite end of the 'V', i.e. the opening to the 'V', the material making up the brackets 7 is bent outwards to present two flat surface portions 9 on each bracket 7 which straddle the V, with each flat surface portion 9 lying flat against the second side 6. In the example shown bolts are introduced through openings (not shown) in the flat parts 9 of the brackets 7 and engaged with corresponding aligned openings (not shown) in the second side 6 of the base 2. Nuts are applied to the bolts and tightened against the bolts so as to bring the 'V' shaped brackets 7 into tight engagement with the second side 6. The bolts are replaced by other suitable fixings such as welding in other otherwise identical examples of the invention.

Each bracket 7 also comprises a clamping member 10. In FIG. 1 the clamping members 10 are steel wedges. The wedges 10 engage through slots 11 in the sides of the brackets 7. On each bracket 7 there is a distal slot 11*a* and an opposite proximal slot (11*b*, not shown). The proximal slot 11*b* is the slot closest to the end of the base 2 connected to the shuttering contact member 3. The distal slot 11*a* is in the opposite position on the respective bracket 7. In the example shown the proximal slot 11*b* is narrower than the distal slot 11*a*. In use the wedge 10 is inserted through the distal slot 11*a* and then through the proximal slot 11*b*. The different widths of the two slots allows the wedge 10 to be introduced and engage with the bracket 7 on all sides of the wedge 10. The slots 11*a* and 11*b* are arranged a distance away from the apex to the 'V' on the bracket 7. Said distance is approximately equal to the width of a standard roadway pin.

The shuttering contact member 3 like the base 2 has a first side 12 and a second side 13. However for the shuttering contact member 3 the first side 12 is the side which is in contact with the shuttering contact board in use. The second side 13 is the side adjacent the first side 12. The shuttering contact member 3 is pivotally attached to the base 2 at the end of the second side 6 of the base 2 and at the end of the second side 13 of the shuttering contact member 3. In this example the attachment is by a conventional nut and bolt fixing which can be tightened to secure the attachment in a fixed orientation. The second side 13 of the shuttering contact member 3 comprises a lower slot 14*a* and an upper slot 14*b*. A hole at the proximal end (end closest to the shuttering in use) of the lower brace 4*a* is aligned with the lower slot 14*a* and slidingly engaged thereto with conventional nut and bolt fixings. A hole at the proximal end of the upper brace 4*b* is aligned with the upper slot 14*b* and slidingly engaged thereto with conventional nut and bolt fixings. A hole at the distal end of the lower brace 4*a* is aligned with a slot 15 in the second side 6 of the base 2 and slidingly engaged thereto with conventional nut and bolt fixings. A hole at the distal end of the upper brace 4*b* is aligned with the same slot 15 in the second side 6 of the base 2 and slidingly engaged thereto with conventional nut and bolt fixings. The ends of the braces 4*a* and 4*b* that are engaged with the slot 15 are required to be separated somewhat as both braces 4*a* and 4*b* are right angle section steel members, and therefore cannot be crossed over. The angle of the shuttering contact member 3 with respect to the base 2 can then be adjusted accordingly by sliding the braces 4*a* and 4*b* within either or both the slots (15, 14*a*, 14*b*) and then tightening the fixings as required. The embodiment of the formwork with the double braces 4*a*, 4*b*, provides double the strength but also allows for the shuttering contact member 3 to be made considerably longer, and therefore much taller walls of concrete can be poured against the formwork 1 when it is constructed. Construction of the formwork in this way is also simple, quick and easy, while also allowing for the construction of walls which are not necessarily vertical and without the use of a crane. Importantly the slot 15 in the second side 6 of the base 2 extends between the two 'V' shaped brackets 7, and said brackets 7 define the proximal and distal limits of the slot 15. The shuttering contact member 3 comprises a number of further holes and slots 16 in the first side 12 which are provided for the attachment of boarding or the like to the first side 12. Another important feature is that the uppermost edge of each bracket 7 comprises a cut out 17. The cut out 17 reduces the overall height of each bracket 7, and therefore the dimensions of the clamping portion (ie the part which clamps on the roadway pin in use). However having the cut out 17 means that the pins (not shown) can be more easily removed after use of the formwork 1 and when the formwork 1 is required to be collapsed for transport.

In other examples of the invention there is a formwork 1 substantially as described above, but there are two wedges 10 in each bracket 7. Both wedges 10 may be introduced from the same direction or from opposite directions, and therefore the dimensions and orientation of the slots in the brackets 7 are altered accordingly. Having two wedges 10 means that the grip on the roadway pin in use is increased.

In use the clamping brackets 7 are attached to the second side 6 as described above, using the bolts as shown, making sure that the brackets 7 are positioned over the openings 8. Then the wedges 10 are inserted through the slots (11*a*, 11*b*) of the brackets 7. In so doing a clamping portion is defined between the wedges 10 and the inside of the brackets 7. Next the end of the second side 13 of the shuttering contact member 3 is attached using a bolt fixing to the end of the second side 6 of the base 2. Care is taken to ensure that some distance is provided between the end of the shuttering contact member 3 and the first side 5, in order to allow for angular alteration of the shuttering contact member 3 with the base 2 if required. Next the braces 4*a* and 4*b* are attached to the base 2 and the shuttering contact member 3 using nut and bolt fixings and as shown and as described above. All the nut and bolt fixings within the formwork work are then tightened when the desired angles of the respective members to each other have been obtained. Next, a road pin is inserted through each of the clamping portions and through the openings 8 and into the ground on which the base 2 is placed. A spot weld may be placed on the narrow end of the wedges 10 to prevent them from being lost after use. Shuttering board may be attached to the shuttering contact board after the angle of the shuttering contact member 3 has been set. Then concrete can be poured against it. The base 2 is prevented from moving or lifting up in any way by the combined effect of the brackets 7 and the wedges 10 to generate a clamping portion which clamps onto the pins. The support base 2 therefore does not move in use with respect to the pins. After the concrete has been poured the formwork 1 can be removed from the site by first pushing out the wedges 10. If the wedges 10 have a spot weld on their end then they will only be released from the slots 11 by a fixed distance, but this will be enough to slacken the wedges 10 from the pins, and the slacken the pressure of the pins against the bottom of the 'V' in the bracket 7. The clamping portion is thereby released and the pins can be removed. The formwork 1 can then be disassembled by unbolting the nuts and bolts described above. Alternatively the nuts and bolts may be just loosened to allow the formwork 1 to be flat packed.

Another advantage of the invention as a whole is that different heights of shuttering contact member 3 and braces 4 can be employed, but still be able to maintain the brace 4 at approximately 45 degrees to the base 2 in use, which the skilled person would understand is the strongest angle.

Deflection Tests Were Performed to Test the Strength of the Above Formwork.

Deflection Test Methods

In the testing, three types of formwork were tested. All had the same overall construction but in the first formwork (bracket D), the height of the shuttering contact member was 1.2 m. In the second formwork (bracket E) the height of the shuttering contact member was 1.8 m. Both brackets D and E were supported by the combination of 'V' shaped clamping brackets and road way pins in the base as described above on a steel framework. The third formwork tested (bracket F) was substantially the same as bracket E, but had a standard base, which was welded through the first side of the bae to the steel frame. In the tests a hydraulic ram was mounted to a steel frame away from the shuttering member and configured to act on the shuttering contact member at a height of 40 cm for bracket D and 60 cm for bracket E and F. The hydraulic ram had a piston diameter of 45 mm. Bracket D was subjected to tests at 50 Bar and 250 Bar. Bracket E was subjected to tests at 100 Bar and 500 Bar. Bracket E (Standard Base) was subjected to a test at 100 Bar. In all cases deflection was measured at various positioned along the length of the shuttering contact member.

Deflection Test Results

TEST 1—Applied Pressure 50 Bar (7952.16N)
Bracket D With Pin Brace Base
Uplift @ base: 2 mm*
Deflection @ Load Point: 6 mm*
Deflection @ 900 mm: 7.5 mm*
Deflection @ 1200 mm: 8 mm*
Note: After the load was removed, the steel members returned to the original state (elastic behaviour retained).
There was no movement/slip on the preloaded bolt connections along the slots.
There was no movement of the wedges securing the road pins.

TEST 2—Applied Pressure 250 Bar (39760.75N)
Bracket D With Pin Brace Base
Uplift @ base: 3 mm*
Deflection @ Load Point: 7 mm*
Deflection @ 900 mm: 8.5 mm*
Deflection @ 1200 mm: 9 mm*
Note: After the load was removed, the steel members returned to the original state (elastic behaviour retained).
There was no movement/slip on the preloaded bolt connections along the slots.
There was no movement of the wedges securing the road pins.

TEST 3—Applied Pressure 100 Bar (15904.3N)
Bracket E With Pin Brace Base
Uplift @ base: 3 mm*
Deflection @ Load Point: 7 mm*
Deflection @ 900 mm: 7 mm*
Deflection @ 1800 mm: 9 mm*
Note: After the load was removed, the steel members returned to the original state (elastic behaviour retained).
There was no movement/slip on the preloaded bolt connections along the slots.
There was no movement of the wedges securing the road pins.

TEST 4—Applied Pressure 500 Bar (79521.5N)
Bracket E With Pin Brace Base
Uplift @ base: 5 mm*
Deflection @ Load Point: 8 mm*
Deflection @ 900 mm: 8 mm*
Deflection @ 1200 mm: 11 mm*
Note: After the load was removed, the steel members returned to the original state (elastic behaviour retained).
There was no movement/slip on the preloaded bolt connections along the slots.
There was no movement of the wedges securing the road pins.

TEST 5—Applied Pressure 100 Bar (15904.3N)
Bracket F With Standard Base
Uplift @ base: 5 mm*
Deflection @ Load Point: 8 mm*
Deflection @ 900 mm: 10 mm*
Deflection @ 1800 mm: 18 mm*
Note: After the load was removed, the steel members returned to the original state (elastic behaviour retained).
There was no movement/slip on the preloaded bolt connections along the slots.
There weld remained intact.

Deflection Test Conclusions

The results for the deflection Tests 1-3 (formwork of the invention) did not change significantly from test to test. It was not until test 4 (also formwork of the invention) did the formwork start to deflect significantly. The results show therefore that the formwork of the invention is able to withstand pressures of up to 500 bar against it, without any significant change in deflection. The results of test 5 (formwork welded to the steel base) came out considerably worse than the results for all the other tests. The deflection of bracket F was considerably higher than the deflection of the bracket E under the same load. This was surprising to the inventor and points towards some synergistic relationship between the features that make up the formwork of the invention. It is postulated that the double brace feature allows not only the better transfer of load than with conventional techniques, but the load is transferred to a region between the two brackets. It is thought that this centres the load between the two anchoring positions. Under load, the second side of the base would be urged towards the ground and force the first side of the base sideways and upwards. The movement of the base is prevented by the action of the clamping portions formed on the pins and this therefore transfers most if not all of the load directly to the ground, so that the deflection is minimal. The inventors would still have expected more deflection that seen because amongst other things, the brackets have the cut out portions, there is a slot between the two brackets on the second side of the base, which weakens the overall structure, only right angle section members were used for the base, shuttering contact member and braces (rather than channel section members which are stronger) and only one clamping member was used in each bracket.

What is claimed is:

1. A concrete formwork comprising:

a base having a first side configured for contact with the ground when in use;

at least two clamping brackets coupled to an adjacent second side of the base and extending over openings in the first side of the base;

a plurality of clamping members, each of the clamping brackets being engageable with a corresponding one of the clamping member to define a clamping portion superimposed over one of the openings, each of the clamping portion being suitable for receiving a pin in use and for retaining the formwork in place with respect to the pin;

each of the clamping brackets comprising a cut-out in a top edge of the bracket to receive an extraction tool;

one end of the second side of the base being pivotally connected to one end of a shuttering contact member;

the shuttering contact member having a first side configured for contacting the shuttering board in use, and a second side adjacent the first side;

a first brace having a first brace first end thereof slidingly engaged with a first longitudinal slot in the second side of the shuttering contact member and an opposite first brace second end thereof being slidingly engaged with a base longitudinal slot spanning a distance between the two clamping brackets in the second side of the base;

a second brace having a second brace first end slidingly engaged with a second longitudinal slot in the second side of the shuttering contact member and an opposite second brace second end being slidingly engaged with the base longitudinal slot spanning the distance between the two clamping brackets in the second side of the base;

wherein the first longitudinal slot is proximal the pivotal connection between the base and the shuttering contact member and the second longitudinal slot is distal the connection between the base and the shuttering contact member; and wherein adjustment of the braces within either or both of the slots causes rotation of the shuttering contact member about the base when in use, an angle of the shuttering contact member with respect to the base being fixable.

2. The formwork according to claim 1, wherein the clamping brackets are substantially "V" shaped.

3. The formwork according to claim 1, wherein the clamping brackets comprise flattened portions configured to lie flat against the second side of the base when in use.

4. The formwork according to claim 2, wherein each of the clamping brackets comprises a first opening and a second opening, the first and second openings being opposite one another and on different sides of the 'V' shaped bracket, the first opening being wider than the second opening, both of the openings being configured to receive a wedge shaped clamping member through the first and second openings, wherein the clamping member substantially matches the dimensions of the first and second openings.

5. The formwork according to claim 1, wherein each of the clamping members comprises a retainer configured to prevent clamping member from being lost when in use.

6. The formwork according to claim 5, wherein the retainer comprises a weld applied to at least one side of the clamping member.

7. A method of constructing a formwork, comprising:

coupling two clamping brackets to a second side of a base, the clamping brackets being arranged to extend over openings in a first side of the base that is adjacent the second side, and each of the clamping brackets comprising a cut-out in a top edge of the bracket to receive an extraction tool;

engaging a respective clamping member with each of the clamping brackets to define clamping portions in each bracket superimposed over the openings;

pivotally connecting a first end of the second side of the base to a first end of a shuttering contact member;

slidingly engaging a first end of a first brace with a first longitudinal slot in the shuttering contact member and slidingly engaging an opposite second end of the first brace with a longitudinal slot spanning a distance between the two clamping brackets in the second side of the base;

slidingly engaging a first end of a second brace with a second longitudinal slot in the shuttering contact member and slidingly engaging an opposite second end of the second brace with the longitudinal slot spanning the distance between the two clamping brackets in the second side of the base;

wherein the first longitudinal slot is proximal a connection between the base and the shuttering contact member and the second longitudinal slot is distal the connection between the base and the shuttering contact member;

adjusting the braces within either or both of the slots to cause rotation of the shuttering contact member about the base, and fixing an angle of the shuttering contact member with respect to the base.

8. The method according to claim 7, further comprising applying a retainer to the clamping members after they have been engaged with the clamping brackets.

9. The method according to claim 8, wherein the retainer comprises a weld applied to at least one side of the clamping member.

10. The method according to claim 7, wherein when in use a roadway pin is inserted through each of the clamping portions to fixedly mount the formwork to the ground.

* * * * *